US006688068B2

(12) United States Patent
Osterberg

(10) Patent No.: US 6,688,068 B2
(45) Date of Patent: Feb. 10, 2004

(54) RECONFIGURABLE ERECTABLE TRUSS STRUCTURE

(75) Inventor: David A. Osterberg, Glendale, AZ (US)

(73) Assignee: Honeywell, Morristown, NJ (US)

( * ) Notice: Subject to any disclaimer, the term of this patent is extended or adjusted under 35 U.S.C. 154(b) by 0 days.

(21) Appl. No.: 10/086,570

(22) Filed: Feb. 28, 2002

(65) Prior Publication Data

US 2003/0159368 A1 Aug. 28, 2003

(51) Int. Cl.[7] ..... E04H 12/00

(52) U.S. Cl. ..... 52/655.1; 52/690; 52/650.1; 52/653.1; 52/655.2; 52/656.9; 52/653.2; 52/81.3

(58) Field of Search ..... 52/690, 650.1, 52/653.1, 655.1, 655.2, 656.9, 653.2, 81.3

(56) References Cited

U.S. PATENT DOCUMENTS 4,027,449 A * 6/1977 Alcalde Cilveti ..... 52/655.2
4,438,615 A * 3/1984 Wendel ..... 53/430
4,781,644 A * 11/1988 Yoshida ..... 446/123

FOREIGN PATENT DOCUMENTS

| | | |
|---|---|---|
| DE | 24 36 628 A1 | 4/1976 |
| DE | 36 29 286 A 1 | 3/1988 |
| DE | 296 20 907 U1 | 1/1997 |
| FR | 2628 461 A1 | 9/1989 |

* cited by examiner

*Primary Examiner*—Carl D. Friedman
*Assistant Examiner*—Steve Varner

(57) ABSTRACT

A strut assembly includes a longitudinal member having a wall and at least a first substantially hollow end portion. A first threaded member is slidably mounted within the first end-portion and is capable of movement along a longitudinal axis of the threaded member between a retracted position and an extended position. The wall has at least a first access opening therein for providing access to the first threaded member. At least a first node is provided having at least one internally threaded radial bore therein which is configured to threadably engage the first threaded member in an extended position.

26 Claims, 4 Drawing Sheets

184

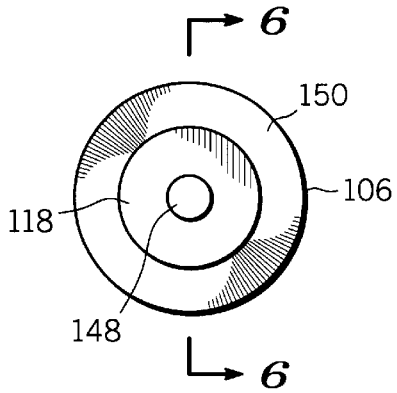
FIG. 5
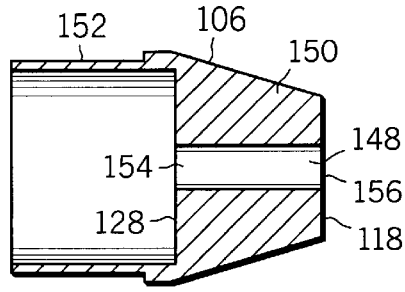
FIG. 6
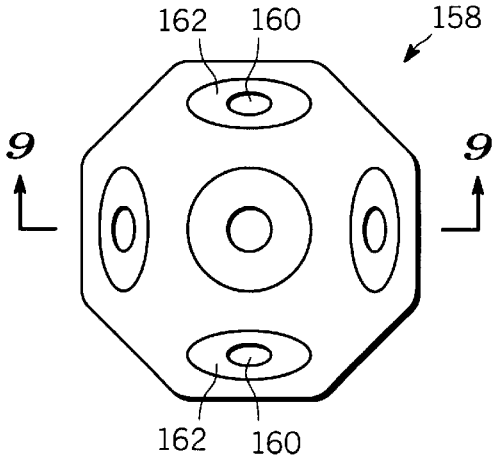
FIG. 7
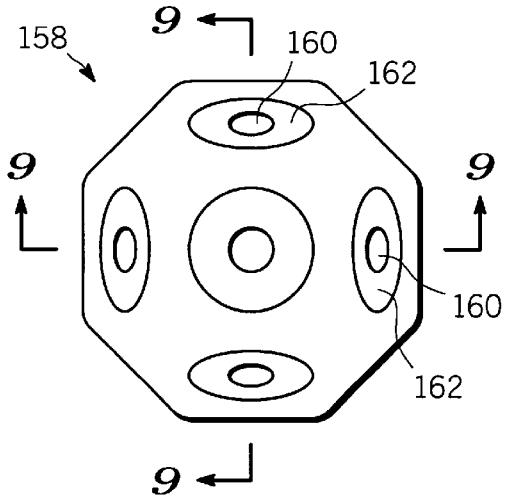
FIG. 8
FIG. 9
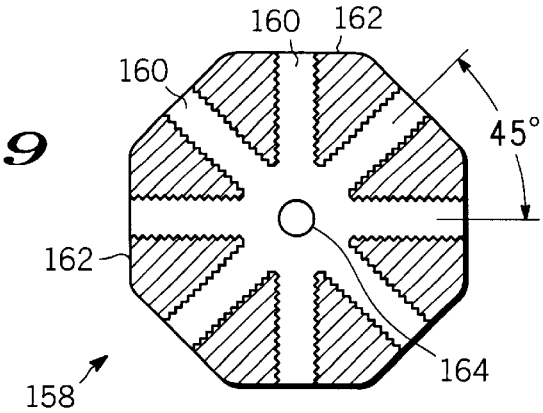

RECONFIGURABLE ERECTABLE TRUSS STRUCTURE

TECHNICAL FIELD

This invention relates generally to truss structures, and more particularly, to strut and node assemblies for use in constructing high precision, reconfigurable trusses.

BACKGROUND OF THE INVENTION

It is well known that large structures may be comprised of elongated struts and nodes that are coupled together to form trusses. Such structures are especially suitable when weight, height, stiffness, and strength are important factors, and increasingly, such structures are being utilized in conjunction with space and metrology systems requiring high precision and reconfigurability. To be suitable for such applications and possess the requisite stability (i.e. measured in the order of nanometers) to produce precision trusses with a high degree of structural integrity, it is necessary that the node/strut coupling assemblies be configured to substantially reduce non-linearity's associated with hysteresis (i.e. the relatively slow deformation of the truss structure due to load and temperature stresses without a subsequent return to normal) and/or stiction (i.e., the sudden deformation of the truss structure, sometimes characterized by a "pop" or "snap" without a commensurate return to normal). Furthermore, such assemblies should be lightweight, relatively inexpensive, and simple and quick to assemble, since such trusses may comprise hundreds or even thousands of struts and coupling nodes. Finally, the strut/node assembly must of a nature that makes even an over constrained system reconfigurable so as to render the overall truss structure capable of being modified for different applications.

One known technique for interconnecting struts to form a truss utilizes clevis joints. That is, the joint comprises a unshaped piece of metal that has a space between the legs thereof. The portion of the member to be secured is positioned within the space, and a pin or bolt is passed through the legs and a portion of the member residing in the space. The bolt is then tightened to secure the member. Unfortunately, this mechanism forms a friction-joint that can slip causing possible variations in the length of the structure and/or angles between joined struts. Since variations are cumulative, the overall structure could suffer significant distortion. In addition to the above problem, such joints are heavy and there fore may not be suitable for space applications.

Another known technique for joining a strut to a node involves the use of internally threaded holes in a node and in a strut that is threadably engaged by a single externally threaded member (e.g. a bolt). First and second internally threaded nuts engage the externally threaded member in the region between the strut and the node and cooperate with the member to secure the strut to the node. The space between the strut and node may be adjusted by manipulating the nuts relative to the externally threaded member on which they are mounted. While this arrangement does not suffer the disadvantage that is associated with respect to the previously described known technique, the joints formed are not strong and will generally always require a length adjustment. Such adjustments are difficult and extremely time consuming in the case of a large truss structure. Furthermore, this arrangement does not lend itself to easy reconfigurability.

Yet another known technique utilizes pipe unions. That is, an internally threaded member grips a portion of a strut and threadably engages an externally threaded stub or protrusion on a node. In this manner, the strut is brought into engagement with and secured to the node. As was the case with the first previously described known technique, joints created in this manner are heavy in addition to being costly.

In view of the foregoing, it should be appreciated that it would desirable to provide a reconfigurable, high precision, highly stable truss structure. It should also be appreciated that is would be desirable to provide an improved method and apparatus for joining struts to coupling nodes to form reconfigurable, high precision truss structures. Finally, it would desirable to provide an apparatus for joining a strut to a coupling node that is lightweight, relatively inexpensive, simple in its construction and deployment, and capable of substantially reducing the above-described problems associated with hysteresis and stiction. Additional desirable features will become apparent to one skilled in the art from the foregoing background of the invention and following detailed description of a preferred exemplary embodiment and appended claims.

SUMMARY OF THE INVENTION

In accordance with a first aspect of the invention, there is provided a strut assembly that comprises a longitudinal member having a wall and at least a first substantially hollow end portion. A first threaded member is slidably mounted within the first end-portion and is capable of movement along a longitudinal axis of the member between a retracted position and an extended position. The wall has a first access opening therein for providing access to the first threaded member.

According to a further aspect of the invention there is additionally provided at least a first node having at least one internally threaded radial bore therein configured to threadably engage the first threaded member when the first threaded member is in an extended position.

According to a still further aspect of the invention there is provided a truss structure comprising a plurality of struts and a plurality of nodes. Each strut comprises a longitudinal member having at least a first substantially hollow end portion and having a wall. A first threaded member is slidably mounted within the first end portion and is capable of movement along a longitudinal axis of the member between a retracted position and an extended position. The wall has a first access opening therein for providing access to the first threaded member. Each strut includes a second substantially hollow end portion and a second threaded member slidably mounted within the second end portion and capable of movement along a longitudinal axis of the member between a retracted position and an extended position. The wall has a second access opening therein for providing access to the second threaded member. Each of the plurality of nodes includes at least a first internally threaded bore therein configured to threadably engage one of the first or second threaded members in one of the plurality of struts in its respective extended position.

BRIEF DESCRIPTION OF THE DRAWINGS

The present invention will hereinafter be described in conjunction with the appended drawings, wherein like numerals denote like elements, and:

FIG. 5 is an end-view of the end-cap shown in FIG. 1;

FIG. 6 is a cross-sectional view of the end-cap shown in FIG. 5 taken along line 6—6;

FIGS. 7 and 8 are top and front views of a coupling node for use in conjunction with the strut assembly shown in FIG. 1 in accordance with a further embodiment of the present invention;

FIG. 9 is a cross-sectional view of the coupling node shown in FIGS. 7 and 8 taken along lines 9—9 in FIG. 7 and lines 9—9 shown in FIG. 8;

DESCRIPTION OF THE PREFERRED EXEMPLARY EMBODIMENT

Figure 1:
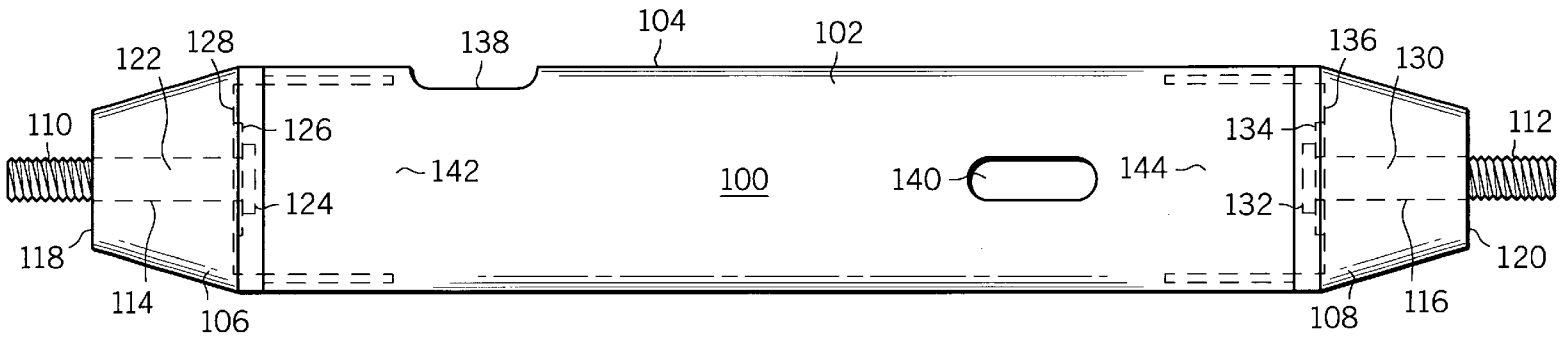
FIG. 1 is a side view of a strut assembly in accordance with a first embodiment of the present invention.

FIG. 1 is a side view of a strut assembly 100 in accordance with a first embodiment of the present invention. Strut assembly 100 comprises a longitudinal, substantially hollow tube or strut member 102 having a wall 104. Coupled to opposite ends of member 102 are first and second end-caps 106 and 108, the details of which will be described more fully below in connection with FIGS. 5 and 6. Externally threaded members 110 and 112 are slidably mounted within longitudinal bores 114 and 116 respectively and are capable of protruding through apertures (not shown) in end faces 118 and 120 respectively. Threaded member 110 comprises a stem portion 122 and a cap or head portion 124. As can be seen, a washer 126 may be positioned around stem 122 between head 124 and an inner surface 128 of end-cap 106. Similarly, threaded member 112 comprises a stem portion 130 and a head or cap portion 132. A washer 134 may be positioned between head 132 and an inner surface 136 of end-cap 108. Heads 124 and 132 are provided with a slot or keyed aperture therein (not shown) to enable threaded members 110 and 112 to be rotated for reasons to be discussed hereinbelow. Access openings or slots 138 and 140 are provided in wall 104 to enable the insertion of a tool such as a ball-end driver so as to impart rotary motion to threaded members 110 and 112 respectively.

Threaded members 110 and 112 are configured to slide within end-caps 106 and 108 respectively so as to enable threaded members 110 and 112 to be fully retracted into strut assembly 100. In their fully retracted positions, the stems 122 and 130 of threaded members 110 and 112 do not protrude from end faces 118 and 120 respectively of end-caps 106 and 108 respectively. It is to be noted that the movement of threaded members 110 and 112 are along an axis substantially co-linear with the longitudinal axis of strut assembly 100. As can be seen strut tube 102 has end portions 142 and 144 having a reduced diameter over which end-caps 106 and 108 are received. End-caps 106 and 108 may be secured to strut tube 102 through the use of, for example, an adhesive bond. Of course, other well known securing mechanisms may be employed.

Figure 2:
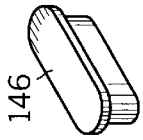
FIG. 2 is an isometric view of one example of a plug suitable for use in conjunction with the strut shown in FIG. 1.

As stated previously, access ports or openings 138 and 140 are provided to provide access to heads 124 and 132 of threaded members 110 and 112 respectively. It is to be noted that in the embodiment shown in FIG. 1, access ports 138 and 140 are radially displaced by 90°. In this manner, the lateral bending stiffness of strut tube 102 is not significantly compromised, as would be the case if openings 138 and 140 were in alignment producing a preferential bending direction. Furthermore, when access to threaded members 110 and 112 via heads 124 and 132 respectively is not required, openings 138 and 140 may be shielded as for example through the use of a plug to both improve the esthetic appearance of the strut assembly and to prevent unwanted contaminants from entering strut tube 102. One example of a plug suitable for this purpose is shown in FIG. 2.

Figure 4:
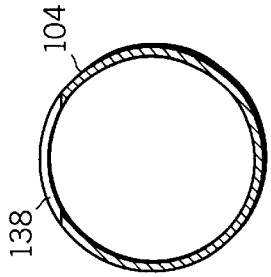
FIG. 4 is a cross-sectional view of the strut tube shown in FIG. 3 taken along line 4—4.
Figure 3:
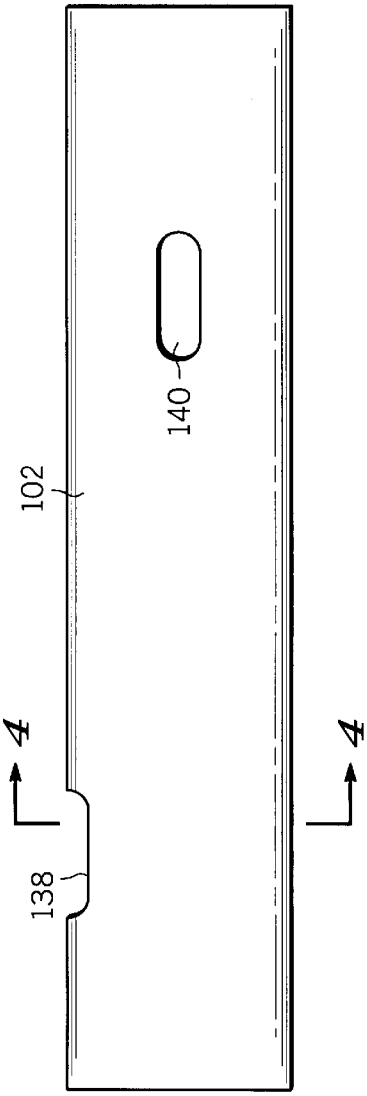
FIG. 3 is a side view of strut tube shown in FIG. 1.

Strut tube 102 is shown in more detail in FIG. 3 (which is a side view of strut tube 102) and FIG. 4 (which is a cross-sectional view of strut tube 102 taken along line 4—4). As can be seen, strut tube 102 is shown as being cylindrical; however, this is not a requirement, and strut tube 102 can have any desired cross-section. Strut tube 102 may consist of anodized aluminum and have a diameter of, for example, 1.5 inches. Strut tube 102 may have a length of, for example, approximately 24 inches, and wall 102 may have a thickness of, for example, 0.35 inches. Access ports or openings 138 and 140 may have a length of, for example, 1 inch and a thickness of, for example, 0.5 inches. It should be understood, however, that these dimensions are given by way of example only, and other dimensions may be chosen to suit a particular purpose or tool. Furthermore, while strut tube 102 has been described as being aluminum, the strut may be made of any other suitable material that possesses the prescribed strength and weight characteristic.

FIG. 5 is an end-view of end-cap 106 (or end-cap 108), and FIG. 6 is a cross-sectional view of end-cap 106 taken along line 6—6 shown in FIG. 5. As can be seen, end-cap 106 has an area of reduced outer diameter 152, which is received within strut tube 102. A bore 148, which is axially aligned with the longitudinal axis of strut tube 102, has an inner opening 154 and an outer opening 156. As shown in FIG. 1, axial bore 148 receives threaded member 112 therethrough. Surrounding opening 156 is a flat surface 118 that is designed to engage complimentary flat surfaces on coupling nodes to be further described hereinbelow. Extending from flat surface 120 is a generally conical surface 150 to reduce interference at the coupling node. As was the case with strut tube 102, end-cap 106 (and 108) is preferably constructed of anodized aluminum; however, other materials may be used that posses the required weight and strength characteristics.

FIGS. 7 and 8 are top and front views of a coupling node 158 for use in conjunction with the strut assembly shown in FIG. 1, and FIG. 9 is a cross-sectional view of coupling node 158 taken along lines 9—9 in FIG. 7 and lines 9—9 shown in FIG. 8. It should be appreciated that the three cross-sectional views are identical and are as shown in FIG. 9. As can be seen, coupling node 158 in generally spherical having a diameter of, for example, 1.9 inches and may likewise be made of aluminum having an anodized surface. Coupling node 158 has provided therethrough a plurality of axial bores 160, each of which has surface openings surrounded by flattened areas 162. Bores 160 are internally threaded and may have an internal diameter of, for example, approximately 0.32 inches, while flat surfaces 162 may have a diameter of, for example, 0.75 inches. Referring to FIG. 9, it can be seen that radial bores 160 have longitudinal axes which intersect the center of coupling node 158 and form angles of substantially 45° with each other. Thus, this coupling node is especially suitable for building cubic truss structures. However, it should be appreciated, that coupling node 158 may be provided with axial bores 160 having a variety of angular relationships so as to be suitable for building trusses of various designs and configurations. That is, coupling node 158 may be precision machined with any desired angles, threads, and mating locations. Internally threaded bores 160 pass through the center of coupling node 158 to provide mating surfaces with the strut assembly which are perpendicular to the longitudinal axis of the strut assembly and which are precisely the proper distance from the node center.

Figure 10:
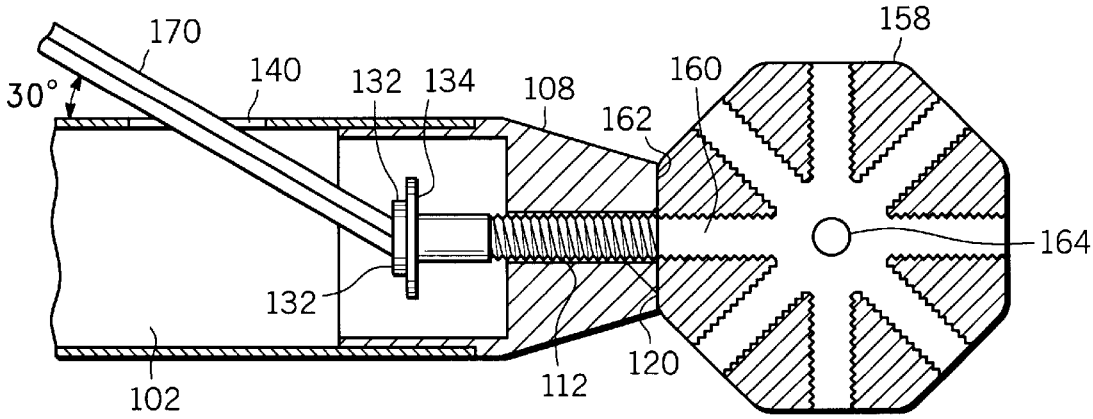
FIG. 10 illustrates the coupling node shown in FIGS. 7 and 8 having flat surface in abutment with a flat surface on the end-cap shown in FIG. 6.
Figure 11:
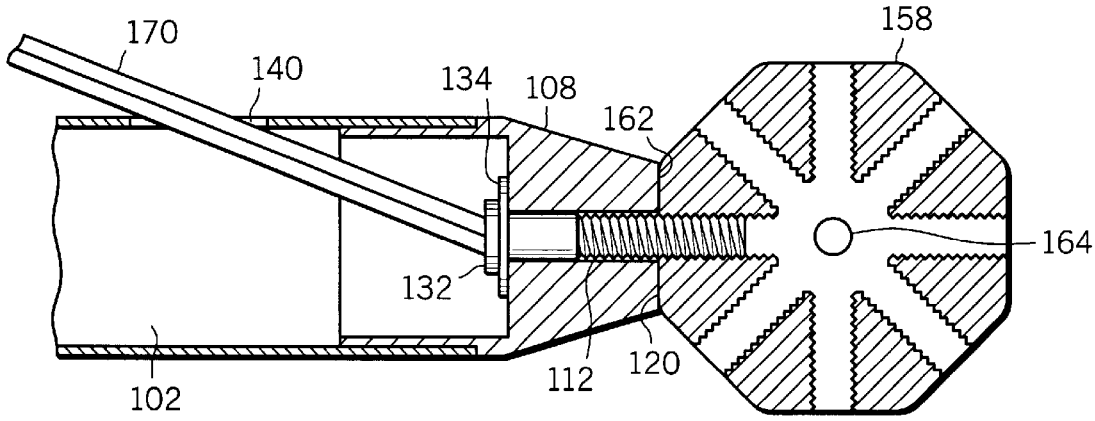
FIG. 11 illustrates the coupling node of FIGS. 7 and 8 secured to the end-cap shown in FIG. 6.

FIG. 10 illustrates coupling node 158 having flat surface 162 in abutment with flat surface 120 of end-cap 108. This flat surface to flat surface configuration resists bending. As can be seen, threaded member 112 is in the filly retracted position within end-cap 108. Threaded member 112 may be rotated so as to threadably engage bore 160 by inserting a tool 170 such as a ball-end driver through access opening 140 so as to engage head 132. As can be seen, tool 170 makes an angle with wall 104 of strut tube 102 of approximately 30°. In FIG. 11, coupling node 158 has been preloaded against face 120 of end-cap 108 by fully screwing externally threaded member 112 into bore 160.

Figure 12:
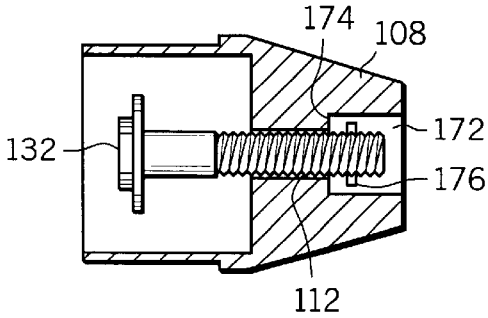
FIG. 12 illustrates a capture mechanism for use in conjunction with the strut assembly shown in FIG. 1.

In order to prevent externally threaded member 112 from being retracted too far, and, perhaps, falling into strut tube 102, a capture mechanism may be provided as shown in FIG. 12. That is, the axial bore through end-cap 108 may be countersunk such as is shown at 172 to provide a lip 174. A retaining ring 176 may then be positioned on externally threaded member 112 as is shown in FIG. 12. In this manner, when threaded member 112 disengages from a coupling node, it is prevented from falling backwards into strut tube 102 when retaining ring 176 comes into engagement with lip 174. It should be clear that many capture mechanisms of this type are known and that the arrangement shown in FIG. 12 is given by way of example only.

Figure 13:
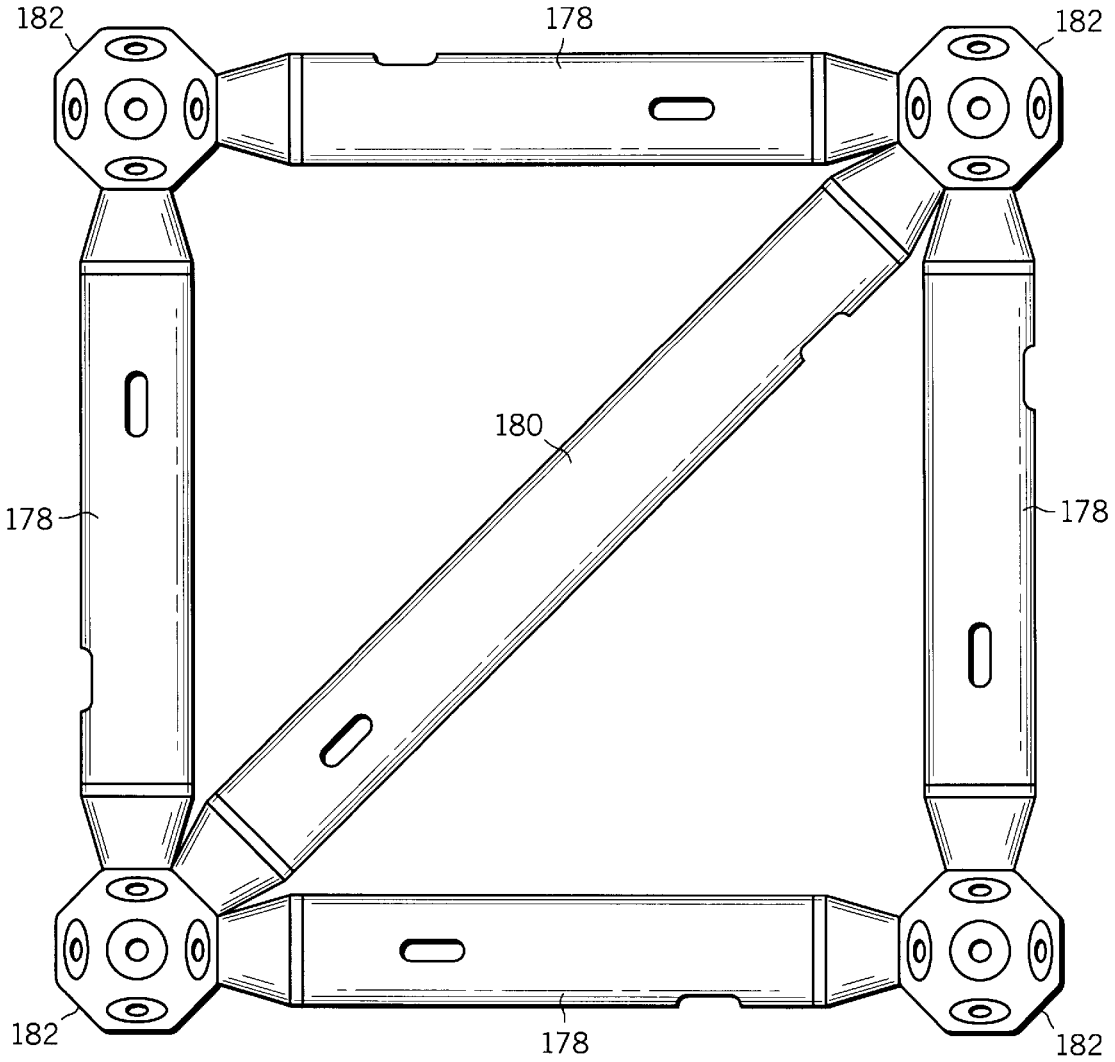
FIG. 13 illustrates a cubic truss structure utilizing strut assemblies of the type shown in FIG. 1 and coupling nodes shown in FIGS. 7, 8, and 9.

Finally, FIG. 13 illustrates a cubic truss structure 184 that utilizes the inventive strut assemblies and coupling nodes described above. The truss comprises side struts 178 and a longer diagonal strut 180 of the type previously described. Coupling nodes 182, also of the type previously described, are utilized to join struts 178 and 180 in the manner described above in connection with FIGS. 10 and 11. It should be clear that while a two-dimensional structure has been shown for clarity, the inventive struts and coupling nodes can be utilized to produce 3-dimentional structures.

Thus, there has been provided a strut structure and coupling node that may be utilized to construct high precision, highly stable truss structures. The coupling apparatus is lightweight, relatively inexpensive, simple in construction and deployment, and capable of substantially reducing the problems associated with hysteresis and stiction as described above. Furthermore, truss structures produced using the above described inventive strut assemblies and coupling nodes are easily reconfigurable since any single strut member may be easily removed and additional strut assemblies added.

While the preferred exemplary embodiment has been presented in the foregoing detailed description, it should be appreciated that a vast number of variations exist. It should also be appreciated that this preferred embodiment is only an example and is not intended to limit the scope, applicability, or configuration of the invention in any way. Rather, the foregoing detailed description provides those skilled in the art with a convenient roadmap for implementing the preferred exemplary embodiment of the invention. It should be understood that various changes may be made in the function and arrangement of elements described in the exemplary preferred embodiment without departing from the spirit and scope of the invention as set forth in the appended claims.

What is claimed is:

1. A strut assembly comprising:

a longitudinal member having a wall and at least a first substantially hollow end-portion; and;

a first threaded member slidably mounted within said first end-portion and capable of moving along a longitudinal axis of said member between a retracted position and an extended position, said wall having a first access opening therein for providing access to said first threaded member;

at least a first end-cap coupled to said first end-portion and having a first longitudinal bore therethrough coaxial with said axis, said first threaded member slidably positioned within said first longitudinal opening wherein said longitudinal member is substantially cylindrical and wherein said first end-cap comprises:

a first substantially flat end surface substantially perpendicular to said axis and having a first aperture therethrough for receiving said first member; and a first substantially conical surface extending from a periphery of said first end surface to said longitudinal member.

2. A strut assembly according to claim 1 wherein said longitudinal member has an inner diameter substantially greater than a diameter of said flat surface.

3. A strut assembly according to claim 2 wherein said first threaded member comprises:

a first externally threaded stem portion slidably positioned within said first longitudinal bore; and a first head portion coupled to said first stem portion and configured to facilitate rotation of said first stem portion, said first head portion accessible through said first access opening.

4. A strut assembly according to claim 3 wherein said longitudinal member is aluminum.

5. A strut assembly according to claim 4 wherein said first end-cap is aluminum.

6. A strut assembly according to claim 5 wherein said longitudinal member and said first end-cap are anodized.

7. A strut assembly according to claim 3 wherein said first head portion is accessible by means of a tool inserted through said first access opening.

8. A strut assembly according to claim 7 further comprising a first capture mechanism for maintaining said first stem substantially within said first longitudinal bore.

9. A strut assembly according to claim 3 wherein said longitudinal member has a second substantially hollow end-portion opposite said first substantially hollow end-portion opposite said first substantially hollow end-portion and further comprising a second threaded member slidably mounted within said second end-portion and capable of movement along said longitudinal axis between a retracted position and an extended position, said wall having a second access opening therein for providing access to said second threaded member.

10. A strut assembly according to claim 9 further comprising at least a second end-cap coupled to said second end-portion and having a second longitudinal bore therethrough coaxial with said axis, said second threaded member slidably positioned within said second longitudinal opening.

11. A strut assembly according to claim 10 wherein said second end-cap comprises:

a second substantially flat end-surface substantially perpendicular to said axis and having a second aperture therethrough for receiving said second member; and a second substantially conical surface extending from a periphery of said second end-surface to said longitudinal member.

12. A strut assembly according to claim 11 wherein said longitudinal member has an inner diameter substantially greater than a diameter of said second flat surface.

13. A strut assembly according to claim 12 wherein said second threaded member comprises:

a second externally threaded stem portion slidably positioned within said second longitudinal bore; and a second head portion coupled to said second stem portion and configured to facilitate rotation of said second stem portion, said second head portion accessible through said second access opening.

14. A strut assembly according to claim 13 wherein said second end-cap is anodized aluminum.

15. A strut assembly according to claim 13 wherein said first access opening is radially offset from said second access opening.

16. A strut assembly according to claim 15 wherein said first access opening is radially offset from said second access opening by approximately 90°.

17. A strut assembly according to claim 15 wherein said second head is accessed by means of a tool inserted through said second access opening.

18. A strut assembly according to claim 15 further comprising a second capture mechanism for maintaining said second stem substantially within said second longitudinal bore.

19. A strut assembly according to claim 1 further comprising at least a first node having at least one internally threaded radial bore therein configured to threadably engage said first threaded member in said extended position.

20. A strut assembly according to claim 19 wherein said at least one radial bore has an opening surrounded by a substantially flat surface for matingly engaging said first end surface.

21. A strut assembly according to claim 20 wherein said first node comprises a plurality of internally threaded radial bores therethrough, each having a surface opening surrounded by a substantially flat surface, and each capable of threadably engaging said first threaded member in said extended position.

22. A strut assembly comprising:

a longitudinal member having a wall and at least a first substantially hollow end portion;

a first threaded member slidably mounted within said first end-portion and capable of movement along a longitudinal axis of said member between a retracted position and an extended position, said wall having a first access opening for providing access to said first threaded member;

at least a first node having at least one internally threaded radial bore therein configured to threadably engage said first threaded member in said extended portion;

at least a first end-cap coupled to said first end-portion and having a first longitudinal bore therethrough coaxial with said axis, said first threaded member slidably positioned within said first longitudinal opening, wherein said longitudinal member is substantial cylindrical and wherein said first end-cap comprises;

a first substantially flat end-surface substantially perpendicular to said axis and having a first aperture therethrough for receiving said first member; and a first substantial conical surface extending from a periphery of said first end-surface to said longitudinal member.

23. A strut assembly according to claim 22 wherein said longitudinal member has an inner diameter substantially greater than a diameter of said flat surface.

24. A strut assembly according to claim 23 wherein said first threaded member comprises:

a first externally threaded stem portion slidably positioned within said first longitudinal bore; and a first head position coupled to said first stem portion and configured to facilitate rotation of said first stem portion, said first head portion accessible through said first access opening.

25. A strut assembly according to claim 22 wherein said at least one radial bore has an opening surrounded by a substantially flat surface for matingly engaging said first end surface.

26. A strut assembly according to claim 25 wherein said first node comprises a plurality of internally threaded radial bores therethrough, each having a surface opening surrounded by a substantially flat surface and each capable of threadably engaging said first threaded member in said extended position.

* * * * *